US010240256B2

(12) United States Patent
Youn et al.

(10) Patent No.: US 10,240,256 B2
(45) Date of Patent: Mar. 26, 2019

(54) ELECTRO SPINNING APPARATUS

(71) Applicant: ELECTRONICS AND TELECOMMUNICATIONS RESEARCH INSTITUTE, Daejeon (KR)

(72) Inventors: Doo Hyeb Youn, Sejong-si (KR); Sun Jin Yun, Daejeon (KR); Changbong Yeon, Gyeonggi-do (KR); Young-Jun Yu, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 135 days.

(21) Appl. No.: 15/592,275

(22) Filed: May 11, 2017

(65) Prior Publication Data

US 2018/0030618 A1 Feb. 1, 2018

(30) Foreign Application Priority Data

Aug. 1, 2016 (KR) ..... 10-2016-0098132
Nov. 18, 2016 (KR) ..... 10-2016-0154405

(51) Int. Cl.
*D01D 5/00* (2006.01)

(52) U.S. Cl.
CPC ..... *D01D 5/0076* (2013.01); *D01D 5/0092* (2013.01)

(58) Field of Classification Search
CPC ... D01D 5/0061; D01D 5/0076; D01D 5/0092
USPC ..... 425/174.8 E, 174.8 R
See application file for complete search history.

(56) References Cited

U.S. PATENT DOCUMENTS 2,168,027 A * 8/1939 Gladding ..... D01D 5/0061 19/296
8,940,194 B2 1/2015 Cui et al.
2005/0233021 A1* 10/2005 Chun ..... D01D 5/0069 425/174.8 E
2013/0042911 A1 2/2013 Jung et al.
2015/0200031 A1 7/2015 Youn et al.

FOREIGN PATENT DOCUMENTS

KR 10-2011-0062216 A 6/2011
KR 10-1260459 B1 5/2013

OTHER PUBLICATIONS

Dan Li et al., "Electrospinning of nanofibers: Reinventing the Wheel?", Advance Materials, vol. 16, No. 14, pp. 1151-1170, Jul. 19, 2004.
Dan Li et al., "Electrospinning of Polymeric and Ceramic Nanofibers as Uniaxially Aligned Arrays", NANO Letters, vol. 3, No. 8, pp. 1167-1171, Jul. 8, 2003.

* cited by examiner

*Primary Examiner* — Timothy Kennedy
(74) *Attorney, Agent, or Firm* — Rabin & Berdo, P.C.

(57) ABSTRACT

An electro spinning apparatus according to embodiments of the inventive concept includes a nozzle unit discharging nano fiber on a substrate, and an alignment device having the substrate disposed thereon and aligning the nano fiber, wherein the alignment device includes a body and an angle adjustment unit adjusting an angle formed by a straight line connecting two electrodes disposed to face each other among the electrodes and the substrate.

20 Claims, 10 Drawing Sheets

ELECTRO SPINNING APPARATUS

CROSS-REFERENCE TO RELATED APPLICATIONS

This U.S. non-provisional patent application claims priorities under 35 U.S.C. § 119 of Korean Patent Application Nos. 10-2016-0098132, filed on Aug. 1, 2016, and 10-2016-0154405, filed on Nov. 18, 2016, the entire contents of which are hereby incorporated by reference.

BACKGROUND

The present disclosure relates to an electro spinning apparatus, and more particularly, to an electro spinning apparatus including an alignment device determining directivity of a nano fiber.

Nano fibers have characteristics such as a supermolecular arrangement effect and high electrical conductivity, and are applied to various technical fields. For example, nano fibers may be used in research for a transistor, a pollutant sensor, a flexible electronic device and a transparent thin film.

SUMMARY

The present disclosure provides an electro spinning apparatus capable of aligning nano fibers in a specific direction.

The inventive concept is not limited to the disclosure set forth herein, and the inventive concept not mentioned herein will be apparently understood by a skilled in the art from the following disclosure.

An embodiment of the inventive concept provides an electro spinning apparatus including a nozzle unit discharging nano fiber on a substrate and an alignment device aligning the nano fiber, wherein the alignment device includes a body, electrodes disposed on the body, and an angle adjustment unit adjusting an angle formed by a straight line connecting at least two electrodes disposed to face each other among the electrodes and the substrate.

In an embodiment, the angle adjustment unit may include a jig coupled to the body to adjust the angle.

In an embodiment, the angle adjustment unit may further include a fixing plate disposed on the body between the electrodes and coupled to the jig.

In an embodiment, the electrodes may be provided in at least one pair, and at least the one pair of the electrodes may be disposed to face each other.

In an embodiment, the fixing plate may further include an insulation film.

In an embodiment, the jig may further include an insulation film.

In an embodiment, the substrate may be disposed on the jig.

In an embodiment, the electro spinning apparatus may further include a substrate disposed on the jig, and the nano fiber may be formed on the substrate.

In an embodiment, the height of an upper surface of each of the electrodes may be greater than the height of an upper surface of the substrate disposed on the jig.

In an embodiment, the electro spinning apparatus may further include a collector disposed to face the nozzle unit, the nano fiber may have a first charge, and the collector may have a second charge different from the first charge or grounded.

In an embodiment, the alignment device may be disposed on the collector.

In an embodiment, the body may have a ring shape.

In an embodiment, the nano fiber may include metal or a carbon-based conductor.

In an embodiment of the inventive concept, an electro spinning apparatus includes a nozzle unit discharging nano fiber on a substrate, a collector disposed to face the nozzle unit, electrodes disposed to face the nozzle unit, and an alignment device aligning the nano fiber formed on the substrate, wherein the alignment device includes a body, and an angle adjustment unit disposed on the body to determine a direction of the nano fiber formed on the substrate.

In an embodiment, the angle adjustment unit may include a jig coupled to the body and having the substrate disposed thereon.

In an embodiment, the angle adjustment unit may further include a fixing plate coupled to the jig to fix the jig.

In an embodiment, the body may include an insulation film.

In an embodiment, the electrodes may be disposed on the body.

In an embodiment, the electrodes may be provided in at least one pair, wherein at least the one pair of the electrodes may be disposed to face each other.

In an embodiment, the electro spinning apparatus may further include a support plate coupled to the jig and having the substrate disposed thereon, wherein the support plate may be rotated with respect to the jig.

In an embodiment, the height of an upper surface of each of the electrodes may be greater than the height of an upper surface of the substrate disposed on the jig.

Particulars of other embodiments are included in detailed description and accompanying drawings.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
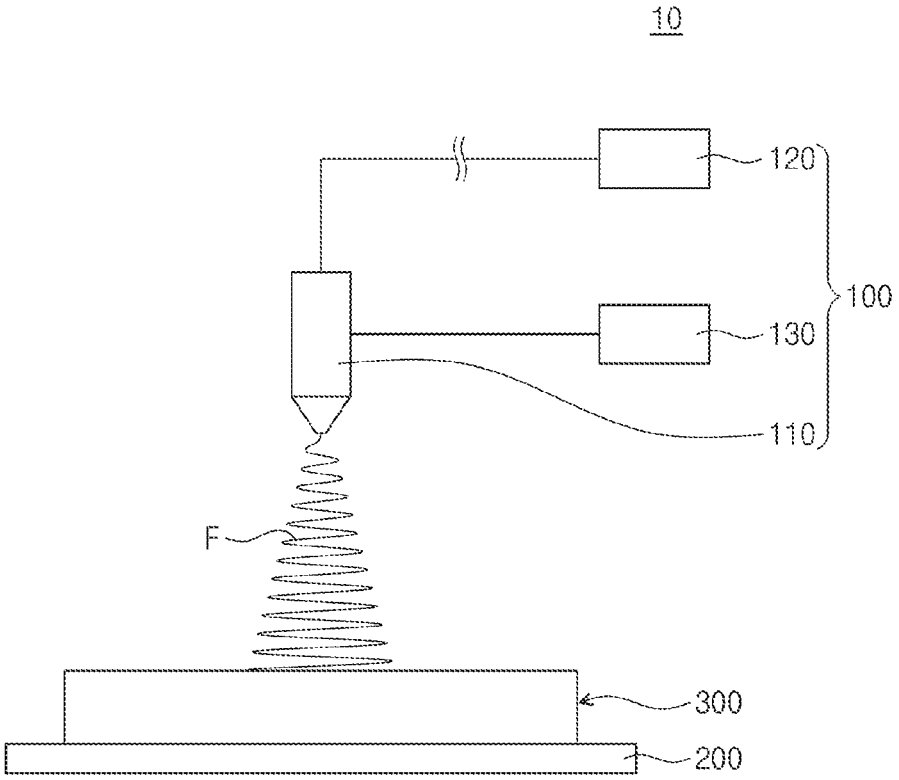
FIG. 1 is a schematic view of an electro spinning apparatus according to an embodiment of the inventive concept.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

In the following description, the technical terms are used only for explaining specific embodiments while not limiting the present invention. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

Additionally, the embodiment in the detailed description will be described with sectional views as ideal exemplary views of the present invention. In the figures, the dimensions of layers and regions are exaggerated for clarity of illustration. Accordingly, shapes of the exemplary views may be modified according to manufacturing techniques and/or allowable errors. Therefore, the embodiments of the present invention are not limited to the specific shape illustrated in the exemplary views, but may include other shapes that may be created according to manufacturing processes. Areas exemplified in the drawings have general properties, and are used to illustrate a specific shape of a semiconductor package region. Thus, this should not be construed as limited to the scope of the present invention.

FIG. 1 is a schematic view of an electro spinning apparatus 10 according to an embodiment of the inventive concept. The electro spinning apparatus 10 may include a nozzle unit 100, a collector 200, and an alignment device 300. The electro spinning apparatus 10 may form nano fibers F by discharging charged polymer solution. When an electric field having a voltage of several hundreds to several thousands of volts is applied between the nozzle unit 100 and the collector 200, the nano fibers F may be formed by an electrostatic force which is greater than the surface tension of the polymer solution discharged from the nozzle unit 100. The polymer solution may include metal or a carbon-based conductor. For example, the polymer solution may include aluminum, magnesium, silver, gold, molybdenum, carbon nano tube, graphene and black carbon.

The nozzle unit 100 may include a nozzle 110, a source unit 120, and a voltage supply unit 130. The nozzle 110 may receive the polymer solution from the source unit 120 and discharge the same. For example, the nozzle 110 is a syringe, and may discharge the polymer solution at a constant pressure. The nozzle 110 may discharge at a speed of several nano liters per minute (nl/min) to several micro liters per minute (μl/min). The voltage supply unit 130 may supply high voltage to the nozzle 110. The nozzle 110 may have a first charge by being applied with a first voltage. For example, the nozzle 110 may have a positive (+) charge by being applied with a positive (+) voltage. Accordingly, the nano fibers F discharged from the nozzle 110 may have the positive (+) charge.

The collector 200 may be disposed to face the nozzle unit 100. The collector 200 may have a planar plate shape. The collector 200 may collect the nano fibers F discharged from the nozzle unit 100. The collector 200 may be applied with a second voltage which is different from the first voltage, or grounded. For example, the collector 200 may be applied with a negative (−) voltage. The collector 200 may have an opposite charge to the charge of the nano fibers F discharged from the nozzle 110.

The alignment device 300 may be disposed on the collector 200. The alignment device 300 may align the nano fibers F. A substrate (S of FIG. 2A) may be disposed on the alignment device 300. The alignment device 300 may determine a direction in which the nano fibers F is formed on the substrate S. Detailed structure and shape of the alignment device 300 will be described later.

Figure 2A:
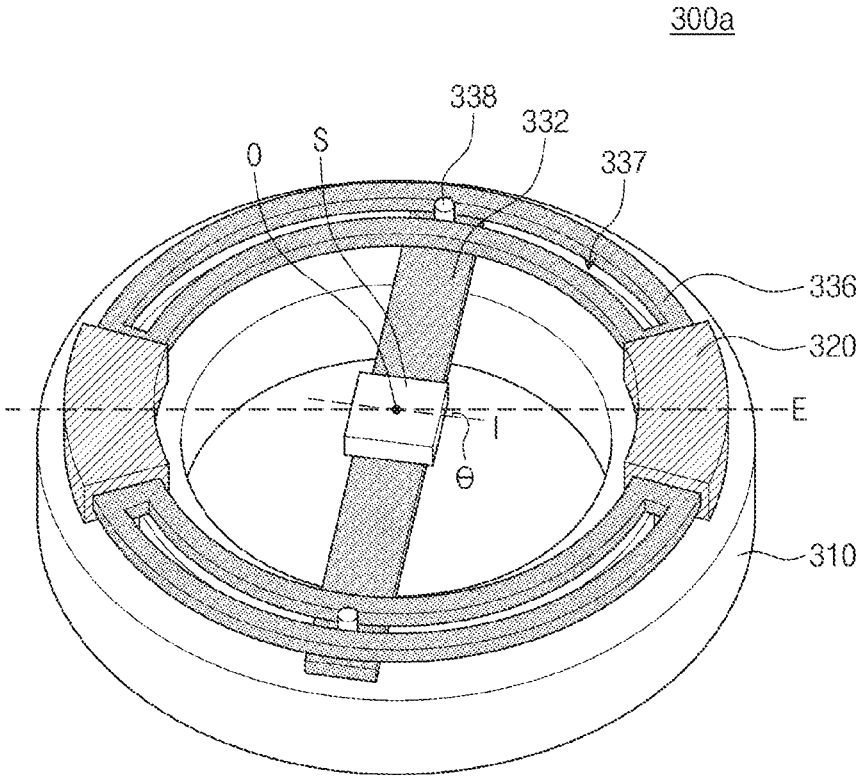
FIG. 2A is a perspective view of an alignment device according to an embodiment of the inventive concept.
Figure 2B:
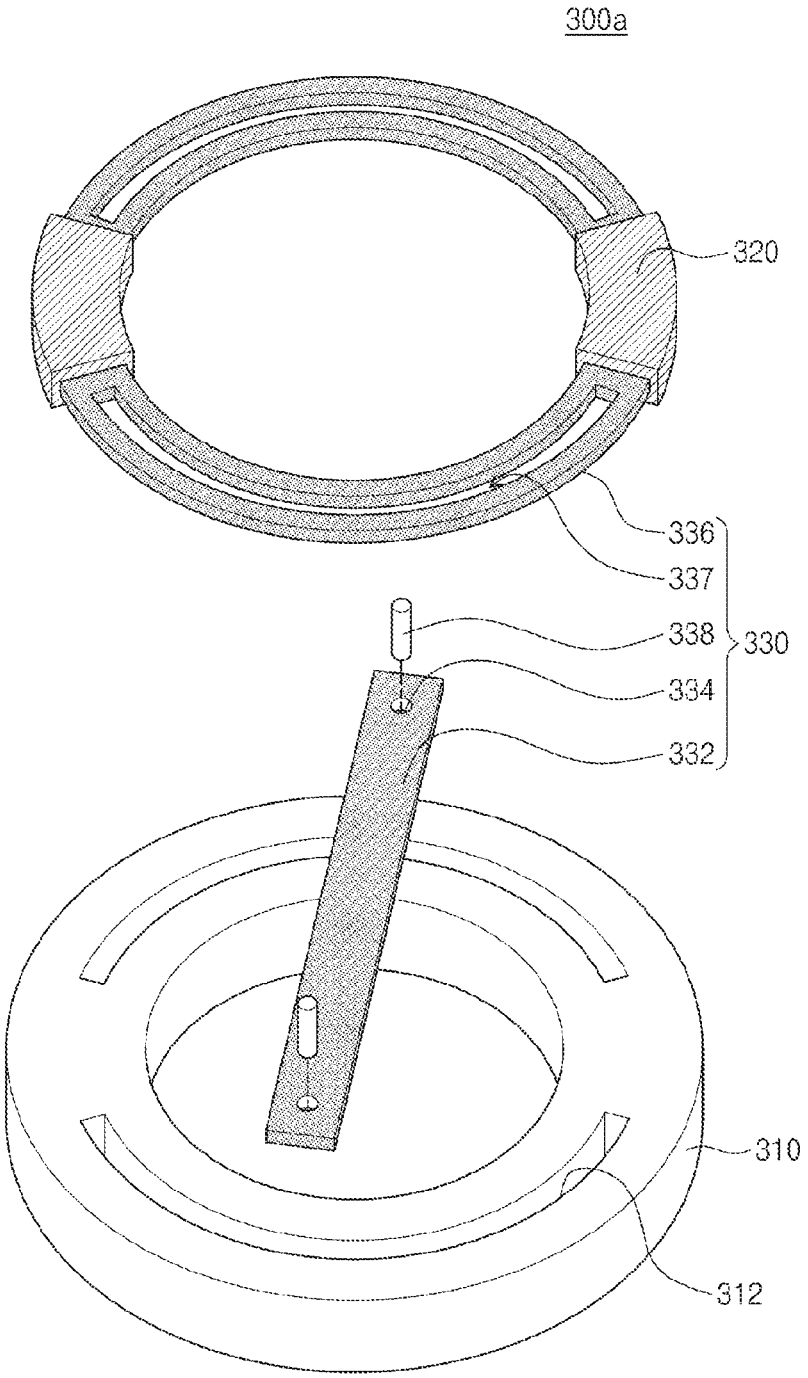
FIG. 2B is an exploded perspective view of the alignment device of FIG. 2A.

FIG. 2A is a view of an alignment device 300*a* according an embodiment of the inventive concept, and FIG. 2B is an exploded view of the alignment device 300*a* of FIG. 2A.

Referring to FIGS. 2A and 2B, the alignment device 300*a* includes a body 310, electrodes 320, and an angle adjustment unit 330. The body 310 may be provided in a ring shape, but the shape of the body 310 is not limited thereto. In another embodiment, the body 310 may have various shapes. A guide groove 312 facing a hollow portion 337 may be defined in the body 310, but not limited thereto. The guide groove 312 may extend along the circumference of the body 310 except for locations on which the electrodes 320 are disposed.

The electrodes 320 may be disposed on the body 310. For example, the electrodes 320 may be disposed on an upper surface of the body 310. The electrodes 320 may be provided in at least one pair. The electrodes 320 may be disposed to face each other. The electrodes 320 may have an identical charge to the charge of the collector 200. That is, the electrodes 320 may have an opposite charge to the charge of the nano fibers F. For example, a negative (−) voltage may be applied to the electrodes 320.

The angle adjustment unit 330 may be disposed on the body 310. The angle adjustment unit 330 may determine a direction in which the nano fiber F is formed on the substrate S. The angle adjustment unit 330 may adjust an angle θ formed by an extension line E of the electrodes 320 and the substrate S. In the present disclosure, the extension line E of the electrodes 320 refers to at least one straight line connecting two electrodes disposed to face each other among the electrodes 320. The direction in which the nano fibers F are formed may be identical to the direction of the extension line E. In the present disclosure, the angle θ formed by the extension line E and the substrate S may be defined as an angle formed, on the plane including the substrate S, by the extension line E extending from one axis I passing the center O of the substrate S, and means a relative angle formed by the one axis I and the extension line E, but is not limited to a specific direction. Also, when nano fibers F in various directions are formed on the substrate S, i.e. when several pairs of electrodes facing each other exist, the angle θ formed by the extension line E and the substrate S may be present in a plurality. The angle adjustment unit 330 may have a jig 332, a fixing plate 336, and a fixing part 338.

The jig 332 may have a bar shape. Holes 334 may be defined on both ends of the jig 332. The jig 332 may be disposed between the body 310 and the fixing plate 336, but not limited thereto. The jig 332 may include an insulation film. For example, the jig 332 may be coated with the insulation film. Outer surfaces of the jig 332 may be coated with the insulation film. The insulation film may include Teflon, plastic or ceramic.

The substrate S may be provided on the jig 332. The substrate S may be disposed on the center of the jig 332. The substrate S may be disposed in parallel with the jig 332, but sizes and/or directions of the jig 332 and the substrate S are not limited thereto.

The fixing plate 336 may be disposed on the body 310 between the electrodes 320. The fixing plate 336 may be provided in a plurality. Referring to FIGS. 2A and 2B, two fixing plates 336 may be disposed. The fixing plate 336 may be provided in a ring shape. The fixing plate 336 may include the hollow portion 337. The hollow portion 337 may face the guide groove 312. The fixing plate 336 may include an insulation film. For example, the fixing plate 336 may be coated with the insulation film. The insulation film may include Teflon, plastic or ceramic.

By including the insulation film, the jig 332 and the fixing plate 336 may induce an electric field applied between the nozzle unit 100 and the alignment device 300*a* to be applied between the electrodes 320. Also, although not illustrated, the insulation film may also be coated on the surface of the body 310.

The fixing part 338 may be provided as a pin. The fixing parts 338 may pass through each of holes 334 to be inserted into the hollow portion 337 and the guide groove 312, respectively. Thus, the fixing parts 338 may combine the jig 332 and the fixing plate 336 and fix the jig 332. An angle formed by the jig 332 and the electrodes 320 may be adjusted according to a location into which the fixing parts 338 are inserted.

It is described as an example that the jig 332 and the fixing plate 336 are combined by inserting the fixing parts 338, but the method of combining the jig 332 and the fixing plate 336 is not limited thereto. For example, the jig 332 may be fixed by a screw or an electromotive device. It is also illustrated as an example that the guide groove 312 and/or the hollow portion 337 are provided in a continuous shape, but the guide groove 312 and/or the hollow portion 337 may be provided in a discontinued shape so as to have a specific angle with respect to the electrodes 320.

Figure 2C:
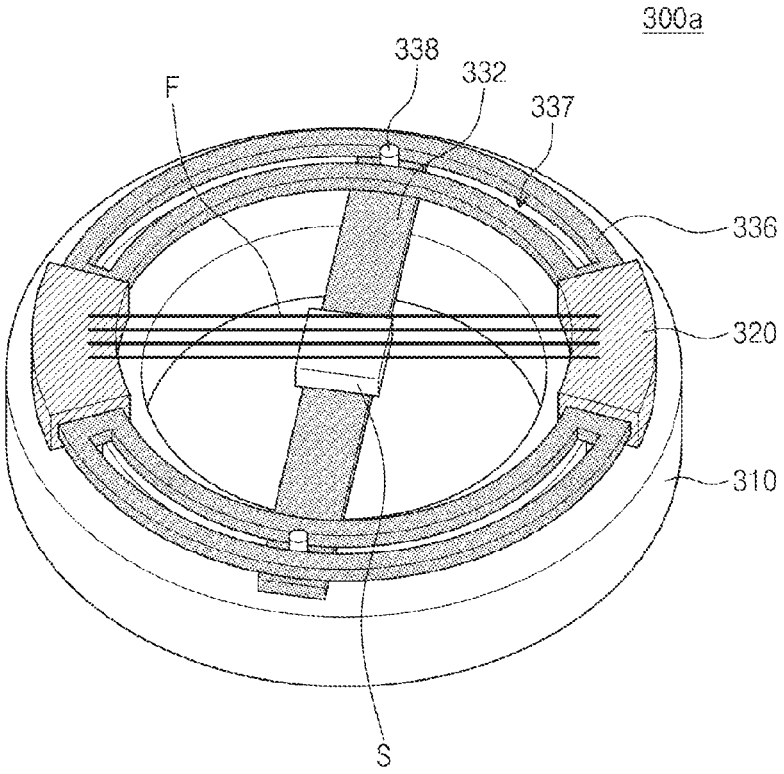
FIG. 2C is a perspective view showing that nano fibers are formed on the alignment device of FIG. 2A.
Figure 2D:
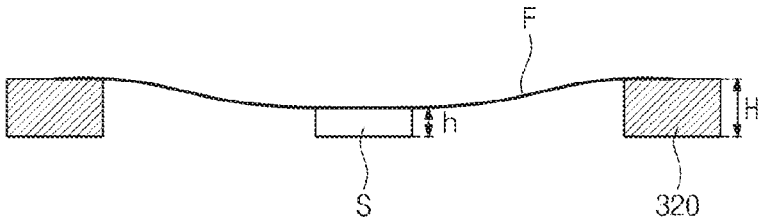
FIG. 2D is a schematic view for comparing the height of electrodes and the height of a substrate.
Figure 2E:
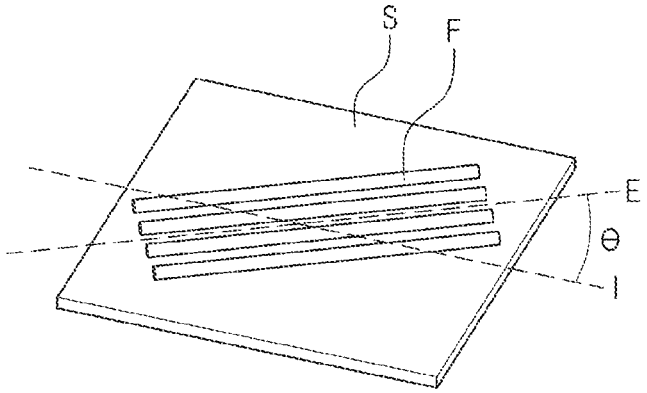
FIG. 2E is a perspective view showing nano fibers formed on the substrate disposed on the alignment device.

FIG. 2C is a view showing that the nano fibers F are formed on the alignment device 300*a* of FIG. 2A. FIG. 2D is a view comparing the height H of electrodes 320 and the height h of the substrate S. FIG. 2E is a view showing the nano fibers F formed on the substrate S disposed on the alignment device 300*a*. FIG. 2D is a schematic view for a height comparison, and a scale in FIG. 2D may be different from an actual scale.

Referring to FIGS. 2C to 2E, the nano fibers F may be formed in parallel with the extension line E. The height H of an upper surface of each of the electrodes 320 may be greater by several nanometers (nm) to several millimeters (mm) than the height h of an upper surface of the substrate S. Due to the height difference, the nano fibers F droop from the electrodes 320 in a lower direction towards the substrate S, and may be disconnected due to a load thereof. For example, the nano fibers F may be disconnected at an edge portion, but not limited thereto. Accordingly, the nano fibers F formed in parallel with each other along one direction may be formed on the substrate S.

According to an embodiment of the inventive concept, the nano fibers F may be formed on the substrate S so as to be aligned in a desired direction. For example, when the nano fibers F are formed to be slanted from one axis I of the substrate S, elasticity of the nano fibers F may be enhanced. In contrast, when the nano fibers F are formed in an identical direction to the one axis I of the substrate S, and stress is applied to the substrate S along the one axis I, the possibility of the nano fibers F being damaged may increase. Also, a separate transcription process may be omitted by directly forming the nano fibers F on the substrate S. By omitting the transcription process, misalignment and disconnection of the nano fibers F, which may occur in the transcription process, may be prevented.

Figure 3A:
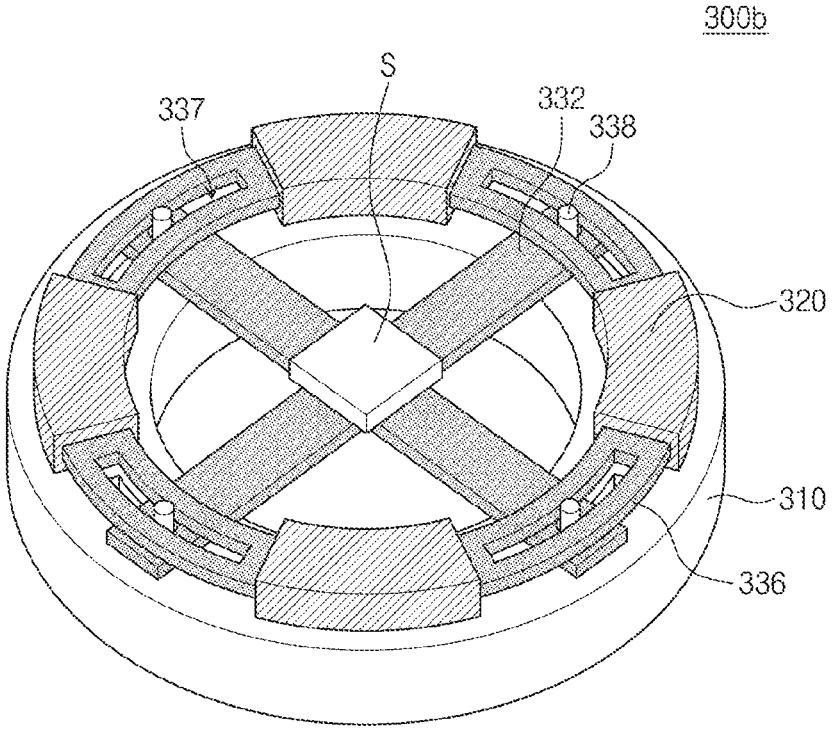
FIG. 3A is a perspective view of an alignment device according to an embodiment of the inventive concept.
Figure 3B:
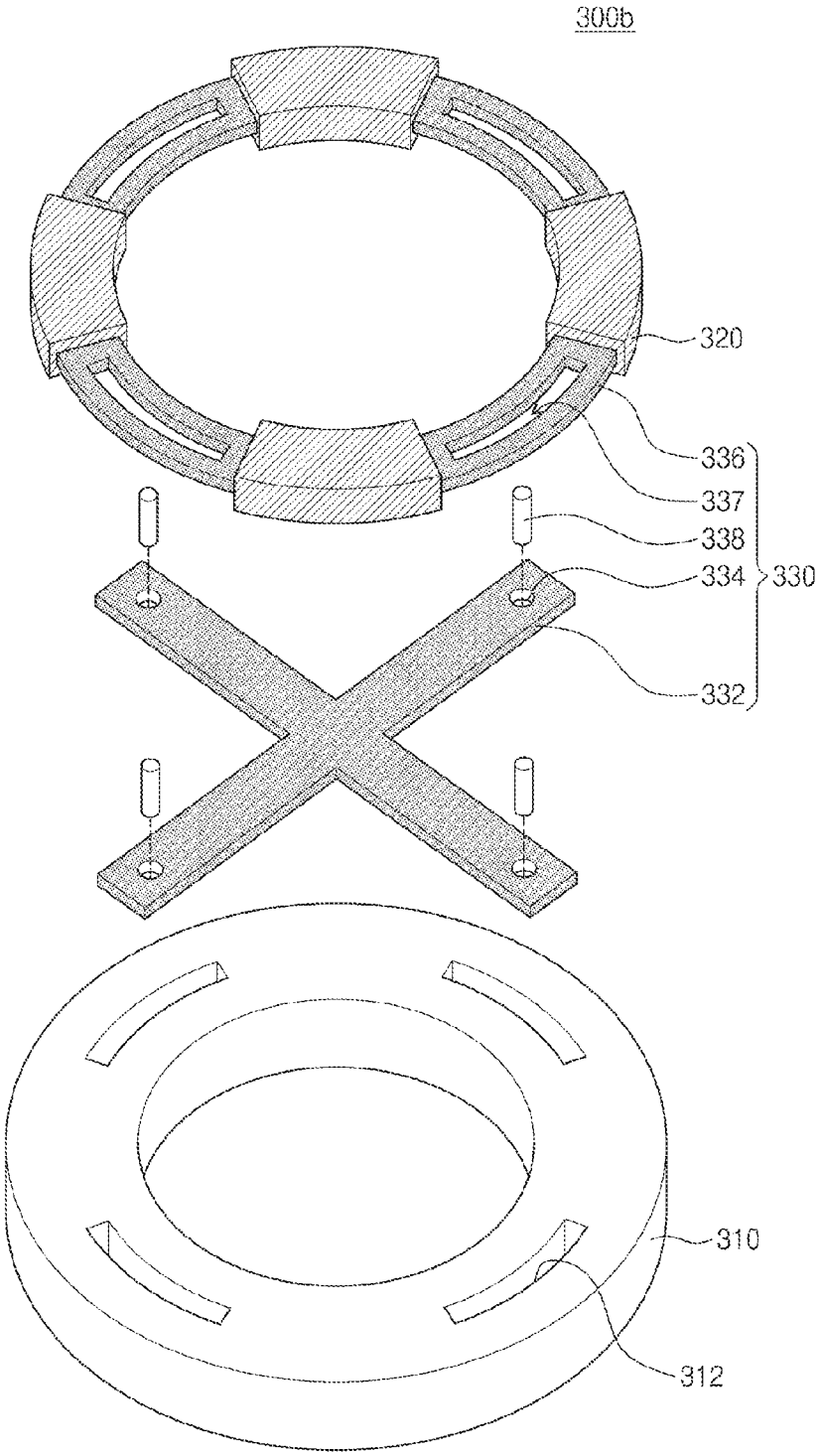
FIG. 3B is an exploded perspective view of the alignment device of FIG. 3A.
Figure 3C:
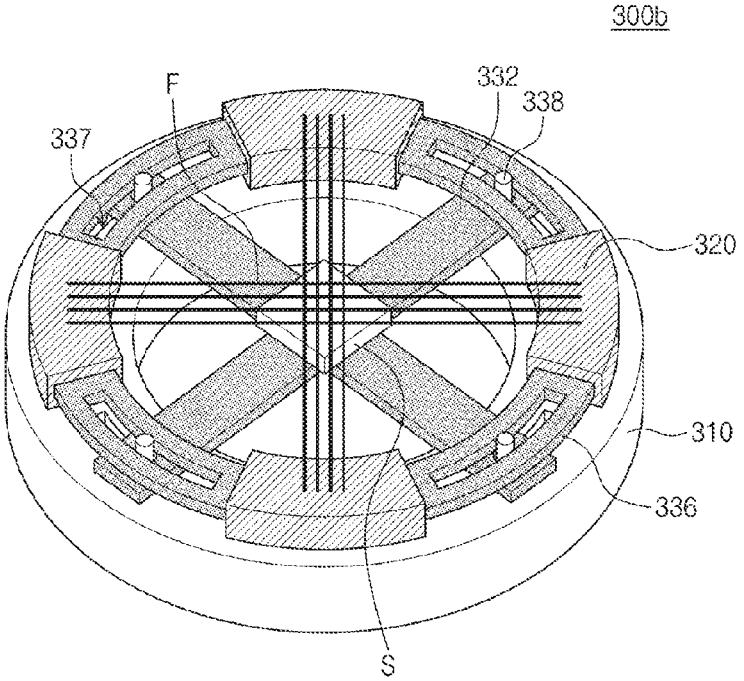
FIG. 3C is a perspective view showing nano fiber being formed on the alignment device of FIG. 3A.
Figure 3D:
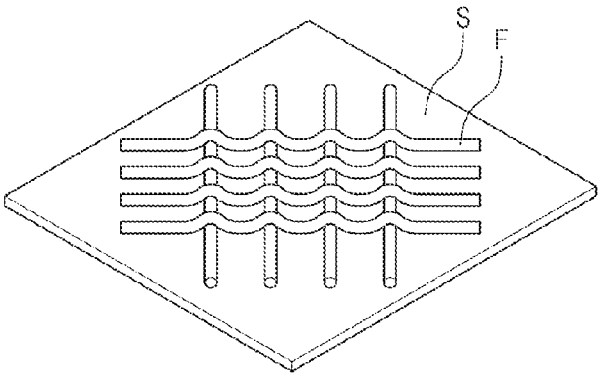
FIG. 3D is a perspective view showing the nano fiber formed on a substrate disposed on the alignment device of FIG. 3A.

FIG. 3A is a view of an alignment device 300*b* according to an embodiment of the inventive concept, and FIG. 3B is an exploded view of the alignment device 300*b* of FIG. 3A. FIG. 3C is a view showing that the nano fibers F are formed on the alignment device 300*b* of FIG. 3A, and FIG. 3D is a view showing the nano fibers F formed on the substrate S disposed on the alignment device 300*b* of FIG. 3A. A configuration which is substantially same as the alignment device 300*a* described with reference to FIGS. 2A to 2E is given the same reference numeral, and a duplicated description thereof may be omitted for simplicity in description.

Referring to FIGS. 3A to 3C, the alignment device 300*b* includes two pairs of electrodes 320, and may include four fixing plates 336. The jig 332 may be provided in a cross shape. The shape and size of the hollow portion 337 and the guide groove 312 may vary in accordance with the shape and size of the fixing plate 336. As two pairs of electrodes 320 facing each other are provided, the nano fibers F may be formed in a shape in which the nano fibers F intercross with each other. For example, as in FIG. 3D, the nano fibers F may be formed in a shape in which the nano fibers F vertically intercross with each other.

Although only the nano fibers which respectively connect two pairs of electrodes disposed to face each other are illustrated, the nano fibers may also be additionally formed between electrodes disposed not to face each other. However, in the present disclosure, only the nano fibers which may be formed on the substrate to connect electrodes disposed to face each other are illustrated, and an illustration for a nano fiber unable to be formed on the substrate is omitted.

Figure 4A:
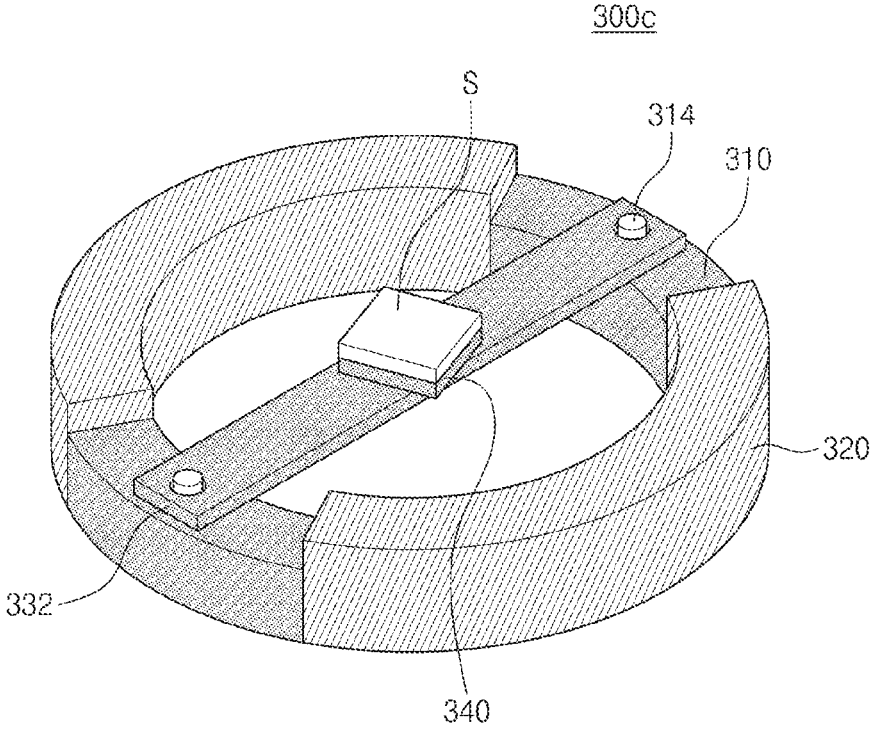
FIG. 4A is a perspective view of an alignment device according to an embodiment.
Figure 4B:
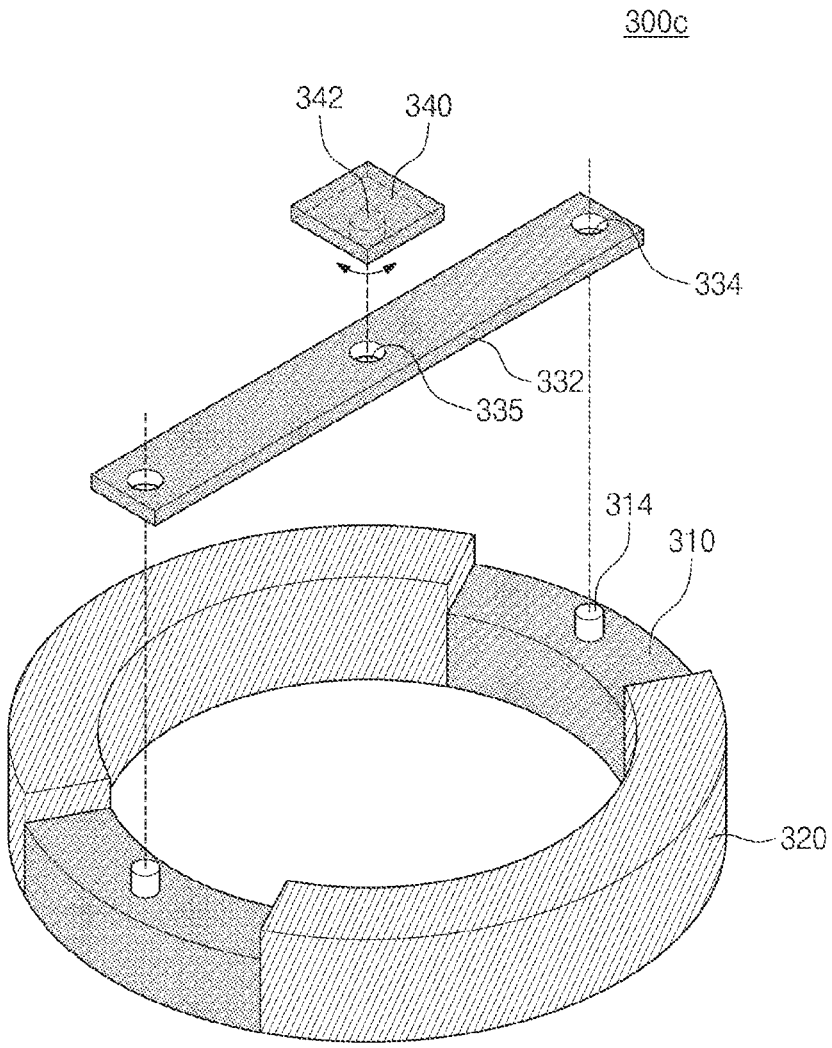
FIG. 4B is an exploded perspective view of the alignment device of FIG. 4A.

FIG. 4A is a view of an alignment device 300*c* according to an embodiment, and FIG. 4B is an exploded view of the alignment device 300*c* of FIG. 4A. A configuration which is substantially same as the alignment device 300*a* described with reference to FIGS. 2A to 2E is given the same reference numeral, and a duplicated description thereof may be omitted for simplicity in description.

Referring to FIGS. 4A and 4B, the body 310 may include an insulation film. For example, the body 310 except for the electrodes 320 may be coated with the insulation film. The insulation film may include Teflon, plastic, or ceramic. The jig 332 may be directly coupled to the body 310. For example, a protrusion 314 of the alignment device 300*c* may be inserted in the hole 334. The jig 332 may further include an auxiliary hole 335 into which a support plate 340 is inserted.

The alignment device 300*c* may further include the support plate 340 rather than the fixing plate (336 of FIG. 2A). The substrate S may be disposed on an upper surface of the support plate 340, and a support part 342 being inserted into the auxiliary hole 335 may be disposed on a rear surface of the support plate 340. The support plate 340 may be rotated with respect to the jig 332. Accordingly, in the alignment device 300*c*, the jig 332 and the substrate S may be disposed in a different direction from each other by the support plate 340, while, in the alignment devices 300*a* and 300*b* described above, the jig 332 and the substrate S are disposed in the same direction. Since the support plate 340 is rotatable, an angle of the nano fibers formed on the substrate S may be adjusted.

Although the abovementioned embodiments exemplarily describes that the alignment devices 300*a*, 300*b*, and 300*c* have the angle adjustment unit 330 having various shapes and configurations, the combinations thereof are only illustrative and the inventive concept is not limited thereto. Also, although it is disclosed that, in the alignment devices 300*a* and 300*b*, the jig 332 and the nano fiber F are formed in the same direction to the direction of the jig 332 and to thus adjust the angle of the nano fiber F and, in the alignment device 300*c*, the jig 332 is fixed, the jig 332 and the nano fibers F are formed in different directions from each other to control the angle of the substrate S and to this adjust the angle of the nano fibers F, the configurations thereof may be combined with each other or substituted.

According to embodiments of the inventive concept, nano fiber may be formed so as to be aligned in a desired direction on a substrate. For example, when the nano fiber is formed to be slanted from one axis of the substrate on the substrate, elasticity of the nano fiber may be enhanced. Also, a separate transcription process may be omitted by directly forming the nano fiber on the substrate. By omitting the transcription process, misalignment and disconnection of the nano fiber, which may occur in the transcription process, may be prevented.

While the present invention has been particularly shown and described with reference to exemplary embodiments thereof, it will be understood by those of ordinary skilled in the art that various changes may be made therein without departing from the scope of the present invention as defined by the following claims. Therefore, technical scope of the present invention should not be construed as limited to those described in the description, but determined by the appended claims.

What is claimed is:

1. An electro spinning apparatus comprising:

a nozzle unit discharging a nano fiber on a substrate; and an alignment device on which the substrate is placed and which aligns the nano fiber, wherein the alignment device comprises:

a body;

electrodes disposed on the body; and an angle adjustment unit adjusting an angle formed by a straight line connecting two electrodes disposed to face each other among the electrodes and the substrate.

2. The electro spinning apparatus of claim 1, wherein the angle adjustment unit comprises a jig coupled to the body to adjust the angle.

3. The electro spinning apparatus of claim 2, wherein the angle adjustment unit further comprises a fixing plate disposed on the body between the electrodes and coupled to the jig.

4. The electro spinning apparatus of claim 1, wherein the electrodes are provided in two pairs or more.

5. The electro spinning apparatus of claim 3, wherein the fixing plate comprises an insulation film.

6. The electro spinning apparatus of claim 2, wherein the jig comprises an insulation film.

7. The electro spinning apparatus of claim 6, wherein the substrate is disposed on the jig.

8. The electro spinning apparatus of claim 2, wherein the level of an upper surface of each of the electrodes is higher than the level of an upper surface of the substrate disposed on the jig.

9. The electro spinning apparatus of claim 1, further comprising a collector disposed to face the nozzle unit, wherein the nano fibers have a first charge, and the collector has a second charge different from the first charge or is grounded.

10. The electro spinning apparatus of claim 9, wherein the alignment device is disposed on the collector.

11. The electro spinning apparatus of claim 1, wherein the body has a ring shape.

12. The electro spinning apparatus of claim 1, wherein the nano fiber comprises metal or a carbon-based conductor.

13. An electro spinning apparatus comprising:

a nozzle unit discharging a nano fiber on a substrate;

a collector disposed to face the nozzle unit;

electrodes disposed to face the nozzle unit; and an alignment device aligning the nano fiber formed on the substrate, wherein the alignment device comprises:

a body; and an angle adjustment unit disposed on the body and configured to determine a direction of the nano fiber formed on the substrate.

14. The electro spinning apparatus of claim 13, wherein the angle adjustment unit comprises a jig coupled to the body and having the substrate disposed thereon.

15. The electro spinning apparatus of claim 14, wherein the angle adjustment unit further comprises a fixing plate coupled to the jig to fix the jig.

16. The electro spinning apparatus of claim 13, wherein the body comprises an insulation film.

17. The electro spinning apparatus of claim 13, wherein the electrodes are disposed on the body.

18. The electro spinning apparatus of claim 17, wherein the electrodes are provided in at least one pair, wherein the at least one pair of the electrodes are disposed to face each other.

19. The electro spinning apparatus of claim 14, further comprising a support plate coupled to the jig and on which the substrate is disposed, wherein the support plate is rotatable with respect to the jig.

20. The electro spinning apparatus of claim 14, wherein the level of an upper surface of each of the electrodes is higher than the level of an upper surface of the substrate disposed on the jig.

* * * * *